US006626426B2

(12) United States Patent
Swinton et al.

(10) Patent No.: US 6,626,426 B2
(45) Date of Patent: Sep. 30, 2003

(54) SELF-SERVICE TERMINAL

(75) Inventors: James D. Swinton, Dundee (GB); Bruce Dunn, Dundee (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/966,025

(22) Filed: Sep. 28, 2001

(65) Prior Publication Data

US 2002/0043756 A1 Apr. 18, 2002

(30) Foreign Application Priority Data

Oct. 17, 2000 (GB) ..... 0025429

(51) Int. Cl.[7] ..... B65H 3/06

(52) U.S. Cl. ..... 271/117; 271/121; 271/122; 271/125

(58) Field of Search ..... 271/117, 121, 271/122, 125

(56) References Cited

U.S. PATENT DOCUMENTS

| | | | | | |
|---|---|---|---|---|---|
| 4,443,006 | A | * | 4/1984 | Hasegawa | 271/10.11 |
| 4,515,358 | A | * | 5/1985 | Fukui | 271/122 |
| 4,715,593 | A | * | 12/1987 | Godlewski | 271/10.11 |
| 5,039,080 | A | * | 8/1991 | Kato et al. | 271/122 |
| 5,106,073 | A | * | 4/1992 | Kawauchi et al. | 271/121 |
| 5,172,899 | A | * | 12/1992 | Tajima | 271/122 |
| 5,301,834 | A | | 4/1994 | Lee et al. | |
| 5,312,098 | A | * | 5/1994 | Inoue | 271/122 |
| 5,470,052 | A | * | 11/1995 | Asakawa et al. | 271/118 |
| 5,651,542 | A | * | 7/1997 | Yamauchi et al. | 271/122 |
| 5,678,817 | A | * | 10/1997 | Saito et al. | 271/122 |
| 5,692,743 | A | * | 12/1997 | Yano et al. | 271/121 |
| 5,967,504 | A | * | 10/1999 | Yankloski | 271/2 |

FOREIGN PATENT DOCUMENTS

| | | | | | |
|---|---|---|---|---|---|
| JP | 57057142 | A | * | 4/1982 | B65H/3/06 |
| JP | 62079134 | A | * | 4/1987 | B65H/3/06 |
| JP | 06144609 | A | * | 5/1994 | B65H/3/06 |
| JP | 06144622 | A | * | 5/1994 | B65H/3/52 |
| JP | 06156783 | A | * | 6/1994 | B65H/3/52 |
| JP | 06171784 | A | * | 6/1994 | B65H/3/52 |
| JP | 06183600 | A | * | 7/1994 | B65H/7/06 |

* cited by examiner

*Primary Examiner*—Donald P. Walsh
*Assistant Examiner*—Matthew J Kohner
(74) *Attorney, Agent, or Firm*—Francis L. Conte

(57) ABSTRACT

A self-service terminal (10) comprising a dispenser (20) having a pick unit (44) for picking media items (64) is described. The dispenser (20) includes a drive wheel (72) for engaging with one surface of a media item and mounted on a drive wheel shaft (78), and a retard wheel (74) for engaging with an opposite surface of the media item and mounted on a retard wheel rotatable shaft (80) for rotating in the same direction as the first rotatable shaft. The drive and retard wheel shafts (78, 80) are coupled to a common drive component (98). The drive wheel (72) and the retard wheel (74) are resiliently biased together, and at least one of the shafts (78 or 80) is pivotally coupled to the common drive component (98) whereby the distance between the at least one shaft (78 or 80) and the drive component (98) remains constant as the at least one shaft (78 or 80) is displaced by a media item passing between the wheels (72, 74).

15 Claims, 5 Drawing Sheets

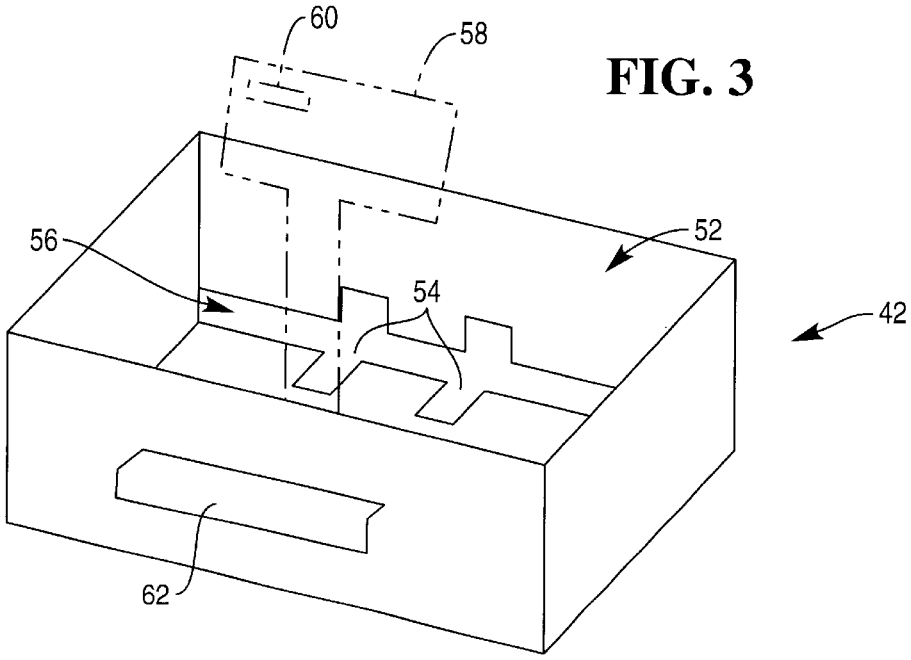
FIG. 3
FIG. 4
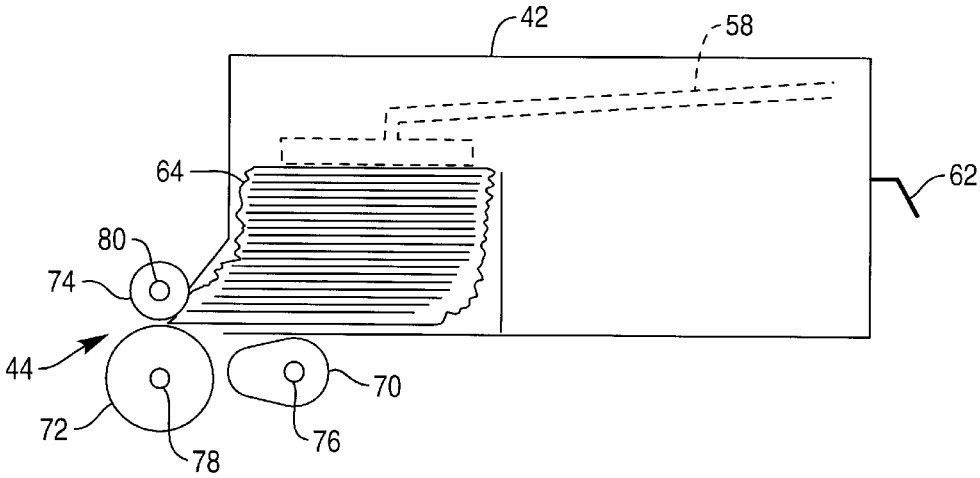

SELF-SERVICE TERMINAL

BACKGROUND OF THE INVENTION

The present invention relates to a self-service terminal (SST). In particular, the present invention relates to an automated teller machine (ATM).

ATMs that dispense cash are well known. However, it is becoming more common for ATMs to dispense other forms of valuable media, such as tickets, postage stamps, coupons, and such like. One problem associated with dispensing other forms of valuable media arises because different types of media items have different thicknesses.

Dispensing media items of different thicknesses means that each type of media item to be dispensed from an ATM is typically stored in a separate cassette or hopper each having an associated pick unit, and each pick unit is configured for the thickness of the media item to be dispensed.

Configuring the pick unit typically involves setting the correct spacing between a drive wheel and a retard wheel. The drive wheel drives a picked media item towards a media exit point, and the retard wheel ensures that the media item remains in contact with the drive wheel and that multiple media items are not picked in a single pick operation.

Configuring each pick unit for a particular media item thickness has the disadvantages of being time consuming and requiring specialized skill; this means that it may be difficult and expensive to change the type of media item that an ATM can dispense.

SUMMARY OF THE INVENTION

It is among the objects of an embodiment of the present invention to obviate or mitigate one or more of the above disadvantages or other disadvantages associated with prior art SSTs.

According to a first aspect of the present invention there is provided a self-service terminal comprising a dispenser having a pick unit for picking media items, where the dispenser includes a drive wheel for engaging with one surface of a media item and mounted on a first rotatable shaft, and a retard wheel for engaging with an opposite surface of the media item and mounted on a second rotatable shaft for rotating in the same direction as the first rotatable shaft, the first and second shafts being coupled to a common drive component, characterized in that the drive wheel and the retard wheel are resiliently biased together, and at least one of the shafts is pivotally coupled to the common drive component whereby the distance between the at least one shaft and the drive component remains constant as the at least one shaft is displaced by a media item passing between the wheels.

By virtue of this aspect of the invention, a dispenser is able to dispense different thicknesses of media items without requiring any adjustment to the distance between the drive wheel and the retard wheel because the wheels are automatically displaced by a media item as it passes between the wheels. As the shaft that is displaced is pivotally coupled to the common drive component, the shaft continues to be driven by the common drive component, even as the shaft is being displaced.

The second shaft may be resiliently biased and located in an arcuate slot, so that as the shaft is displaced it moves within an arcuate slot, thereby maintaining a constant distance from the drive component.

The drive component may be part of a drive mechanism implemented by intermeshing gears. The second shaft may be driven by a retard gear, and the second shaft may be pivotally coupled to a bracket by an arm. The arm may have a pivot point at the center of a common drive gear (the common drive component) used to drive, directly or indirectly, the first and the second shafts. By having a common drive gear at the pivot point, the retard gear and the common drive gear remain in meshing engagement as the arm pivots.

Alternatively, the common drive component may be part of a drive mechanism implemented by stretchable endless belts; the endless belts may be toothed to provide improved grip.

The common drive component may be part of a drive mechanism comprising, for example, multiple gears and/or multiple stretchable endless belts. The common drive component may be an idler part of the drive mechanism.

According to a second aspect of the present invention there is provided a dispenser for dispensing different types of media items, the dispenser comprising a drive wheel for engaging with one surface of a media item and mounted on a first rotatable shaft, and a retard wheel for engaging with an opposite surface of the media item and mounted on a second rotatable shaft for rotating in the same direction as the first rotatable shaft, the first and second shafts being coupled to a common drive component, characterized in that the drive wheel and the retard wheel are resiliently biased together, and at least one of the shafts is pivotally coupled to the common drive component whereby the distance between the at least one shaft and the common drive component remains constant as the at least one shaft is displaced by a media item passing between the wheels.

According to a third aspect of the present invention there is provided a dispenser for dispensing different types of media items, the dispenser comprising a drive wheel for engaging with one surface of a media item and mounted on a first rotatable shaft, and a retard wheel for engaging with an opposite surface of the media item and mounted on a second rotatable shaft for rotating in the same direction as the first rotatable shaft, characterized in that the drive wheel and the retard wheel are resiliently biased together, and at least one of the shafts is pivotally mounted and coupled to a drive component, whereby the distance between the at least one pivotally mounted shaft and the drive component remains constant as the at least one pivotally mounted shaft is displaced by a media item passing between the wheels.

The drive component may be coupled to only one of the shafts (the pivotally mounted shaft). Alternatively, the drive component may be common so that it is coupled to both shafts.

BRIEF DESCRIPTION OF THE DRAWINGS

These and other aspects of the present invention will be apparent from the following specific description, given by way of example, with reference to the accompanying drawings, in which:

FIG. 3 is a schematic diagram illustrating a hopper of the dispenser of FIG. 2;

FIG. 4 is a schematic diagram illustrating the hopper of FIG. 3 engaging with a pick unit of the dispenser of FIG. 2;

DETAILED DESCRIPTION

Figure 1:
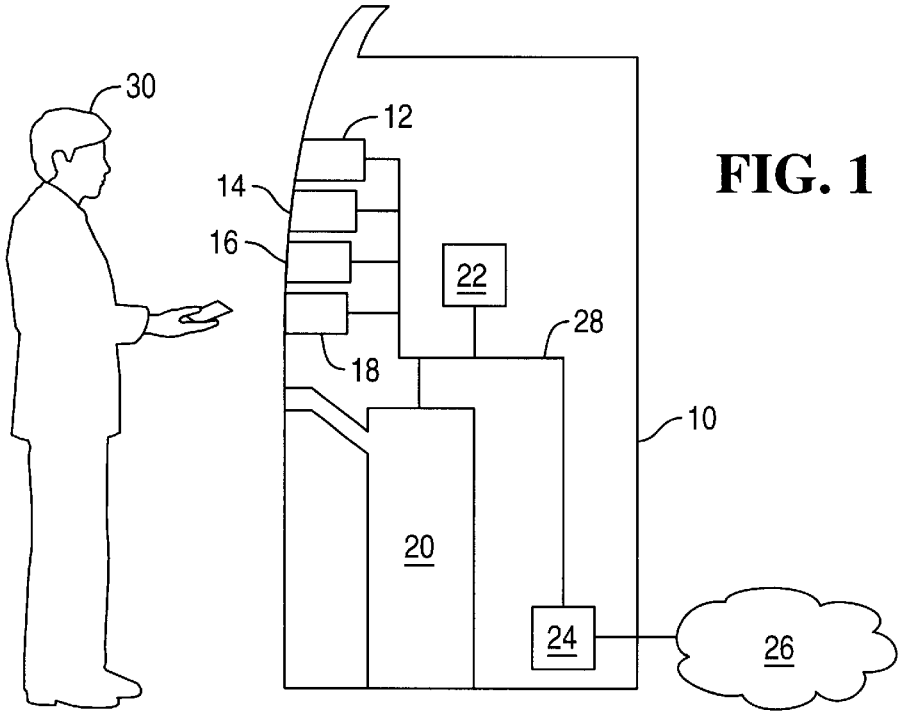
FIG. 1 is a schematic diagram of a self-service terminal according to one embodiment of the present invention.

Reference is now made to FIG. 1, which shows a public access SST 10 in the form of an ATM, according to one embodiment of the present invention.

The ATM 10 includes a touchscreen display module 12, a magnetic card reader/writer (MCRW) module 14, a receipt printer module 16, an internal journal printer module 18 for recording all transactions performed by the ATM 10, a cash dispenser module 20, an ATM controller module 22 for controlling the operation of the various modules, a network connection module 24 for communicating with a remote transaction host (not shown) via a network 26. All of the modules within the ATM 10 are interconnected by an internal bus 28 for conveying encrypted data. FIG. 1 also illustrates a user 30 operating the ATM 10.

Figure 2:
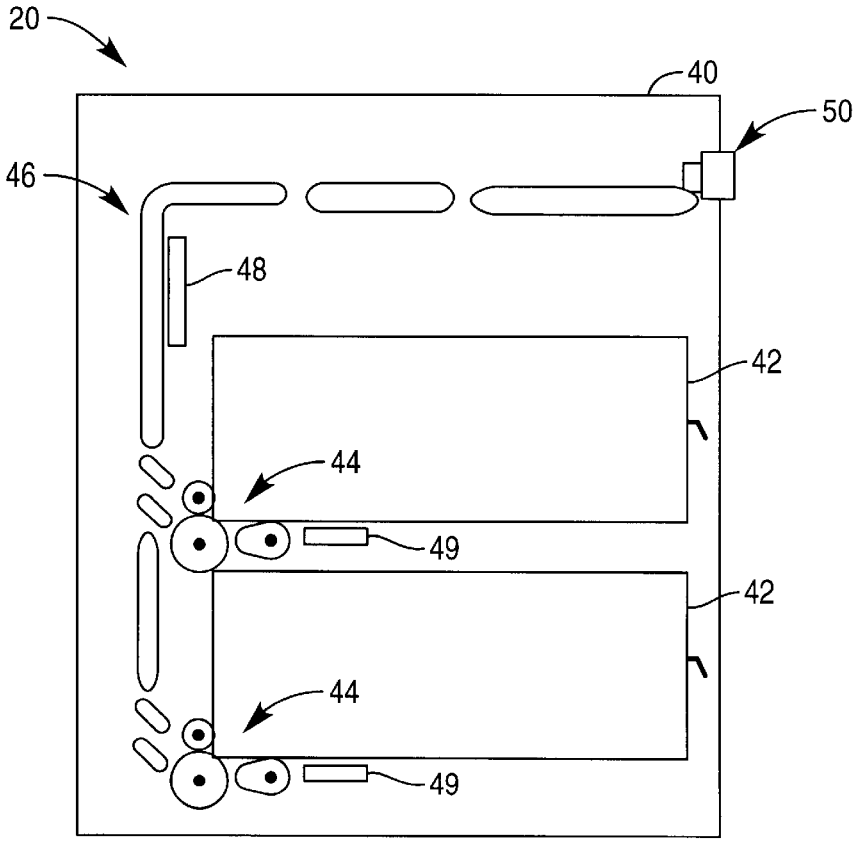
FIG. 2 is a schematic diagram of a part (the dispenser) of the terminal of FIG. 1.

The dispenser 20 will now be described with reference to FIG. 2. Dispenser 20 is a friction pick dispenser and comprises a metal chassis 40 into which two removable hoppers 42 are slidably inserted.

On insertion, each hopper 42 aligns with an associated pick unit 44. Dispenser 20 further comprises a transport mechanism 46, a media thickness sensor 48, a media low indicator 49, and an exit point 50 through which media items are dispensed.

The hoppers 42 will now be described in more detail with reference to FIG. 3, which is a schematic diagram of one of the hoppers 42.

Each hopper 42 has an open top 52, and a bottom defining two slots 54 at an open pick area 56. A pusher plate 58 (shown in dotted lines) is pivotally mounted to the hopper 42 near the open top 52. The plate 58 urges media items (not shown in FIG. 3) stored in the hopper 42 downwards towards the open pick area 56. The pusher plate 58 includes a magnet 60 on a surface in contact with the media items. The hopper 42 has a handle 62 for inserting and removing the hopper 42 into the chassis 40. To replenish a hopper 42 with media items such as banknotes, the plate 58 is lifted, the notes are placed in the hopper 42 as a bunch, with the large faces of each note parallel to the bottom surface of the hopper 42, and the plate 58 is replaced so that it urges against the top note in the bunch.

When a hopper 42 storing media items 64 in the form of banknotes is inserted into the dispenser 20, the open pick area 56 aligns with an associated pick unit 44, as illustrated in FIG. 4.

Figure 5:
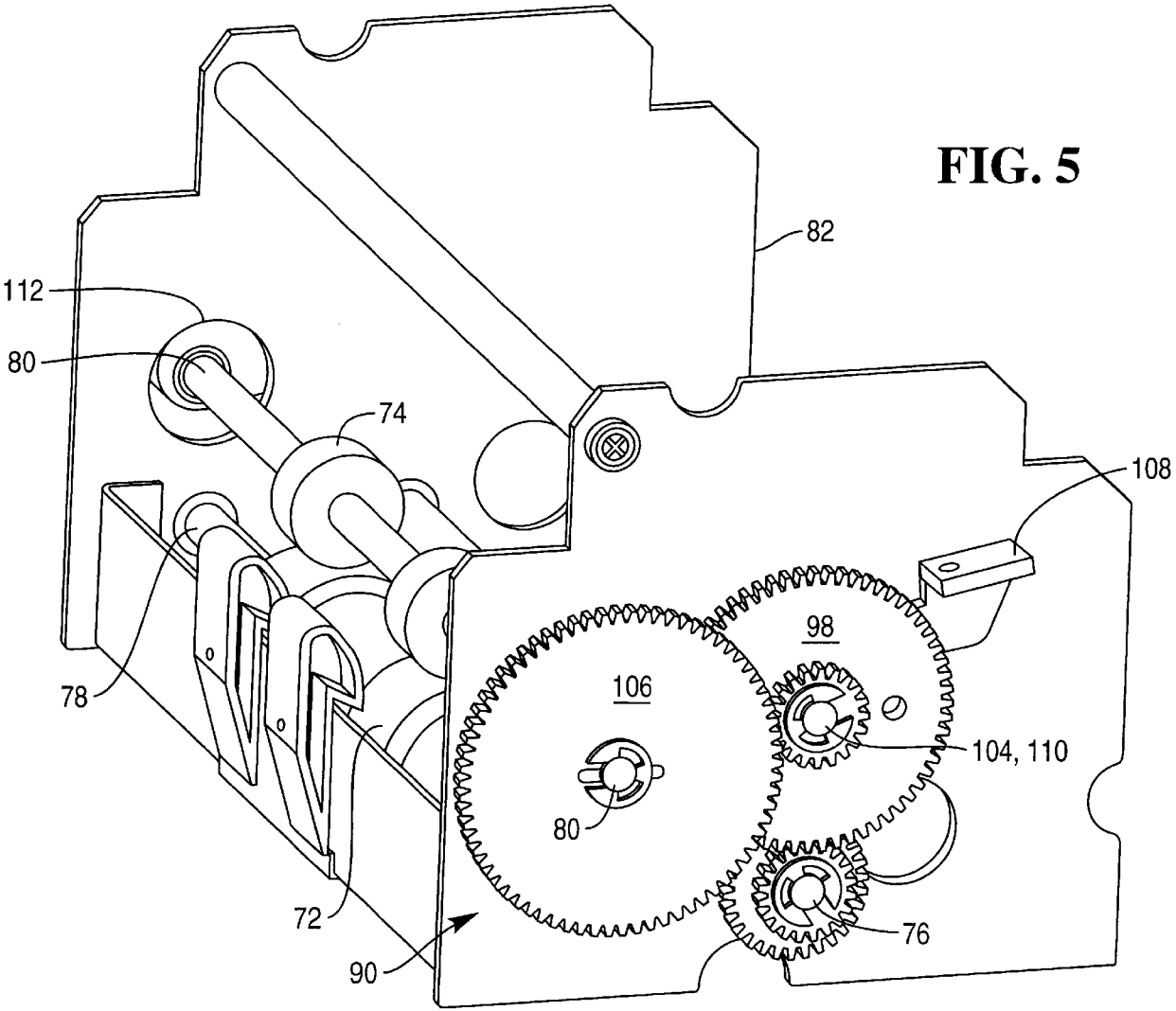
FIG. 5 is a schematic perspective view of a part (the pick unit and supporting chassis) of FIG. 2.
Figure 6:
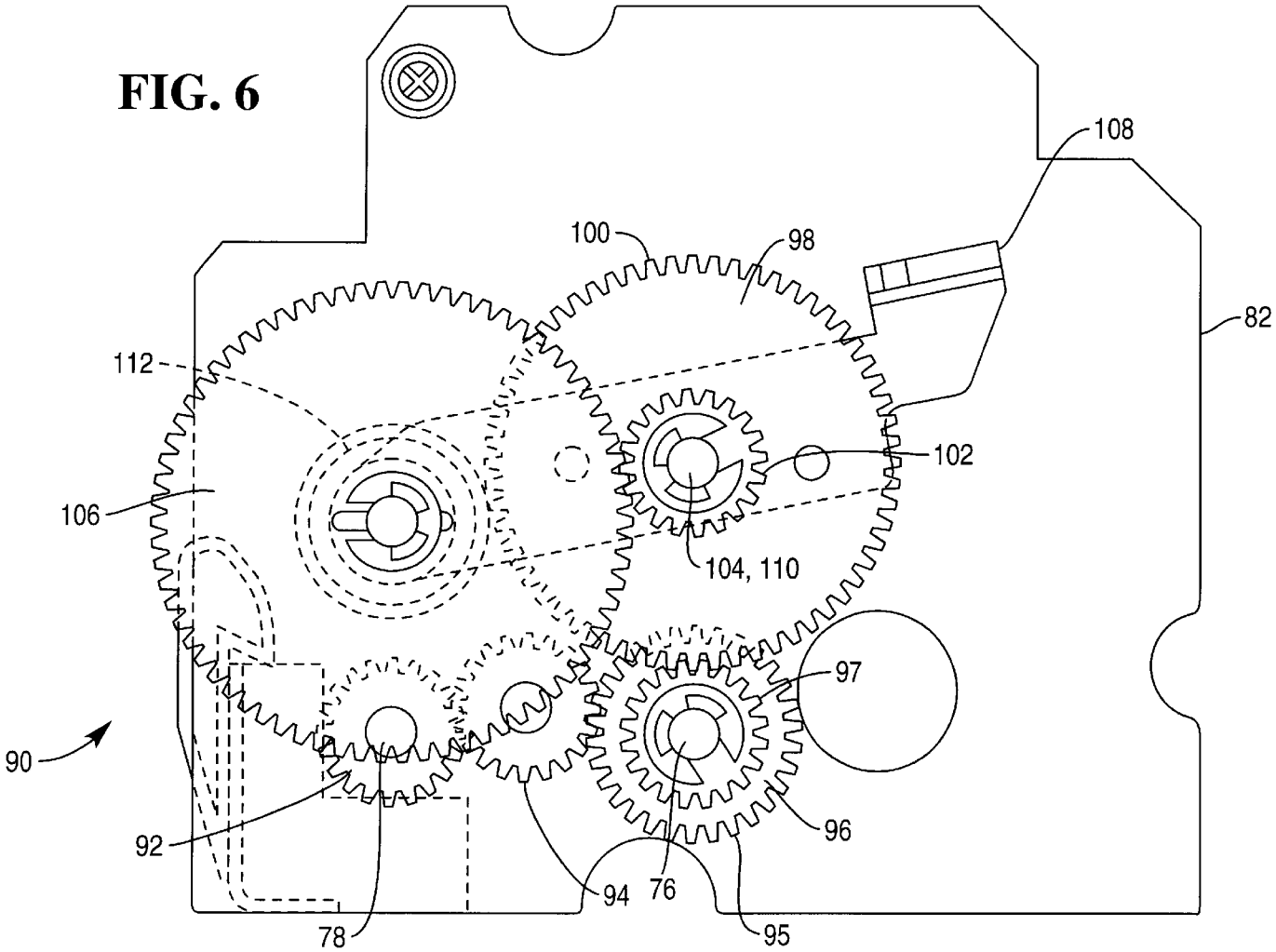
FIG. 6 is a schematic side view of the pick unit and supporting chassis of FIG. 5.

Referring to FIGS. 4 to 6, each pick unit 44 comprises a pair of pick wheels 70 for picking individual media items 64 from the open end 56 of the hopper 42, a pair of drive wheels 72 for engaging with a lower surface of a media item and for driving the item towards the exit point 50, and a pair of retard wheels 74 for engaging with an upper surface of a media item and pushing the item downwards and in a direction opposite the exit point 50. The retard wheels 74 reduce the possibility of a plurality of items being picked by the pick wheels 70 as a single item.

The pick wheels 70 are similar to circular arc nose harmonic cams, and are mounted on a pick shaft 76. The pick wheels 70 align with the slots 54 so that as the pick wheels 70 rotate, the wheels protrude through the slots 54, engage with a note, and drive the note towards the drive wheels 72.

The drive wheels 72 are circular and are mounted on a first (drive wheel) shaft 78. The drive wheel shaft is driven directly by a motor (not shown). The retard wheels are smaller than the drive wheels 72, are circular, have a high friction surface, and are mounted on a second (retard wheel) shaft 80.

Figure 7:
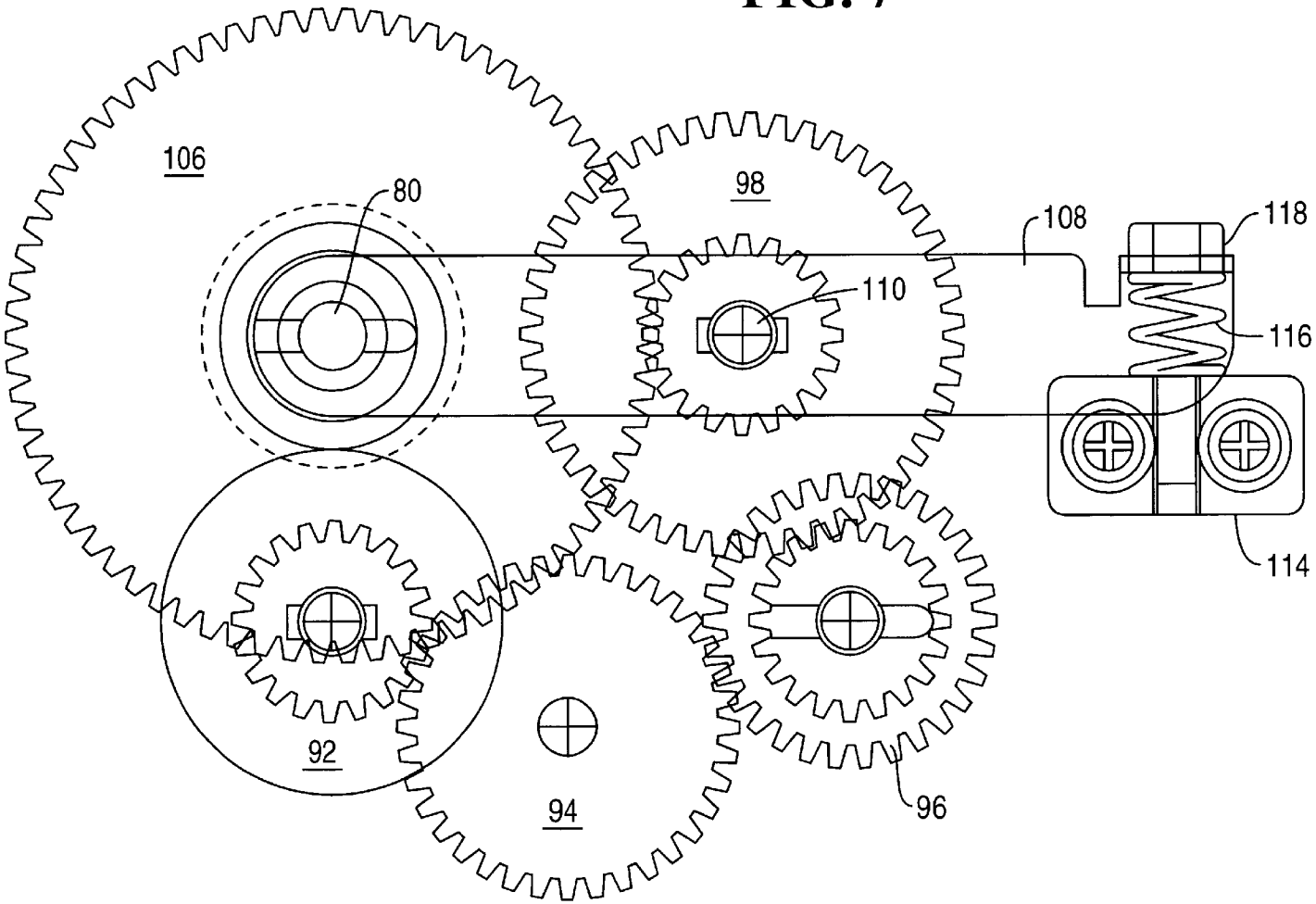
FIG. 7 is a schematic view of a part of the pick unit (the drive mechanism and the pivotable arm) of the dispenser of FIG. 2.

Referring particularly to FIGS. 5, 6, and 7, which show the pick unit 44 and supporting chassis 82, the drive wheel shaft 78 is coupled to a drive mechanism 90 comprising five intermeshed gears. A drive wheel gear 92 is mounted on the drive wheel shaft 78 and intermeshes with an idler gear 94 which also intermeshes with a large radius gear surface 95 of a pick wheel double gear 96. The other (small radius) gear surface 97 of the pick wheel double gear 96 intermeshes with a common component 98 in the form of a double idler gear.

The pick wheel double gear 96 is mounted on the pick wheel shaft 76.

The double idler gear 98 also has two gear surfaces, one having a large radius 100 and intermeshing with the small gear surface 97, the other having a small radius 102. The center of the double idler gear 98 is mounted on a stud 104. The small radius 102 intermeshes with a retard wheel gear 106.

The retard wheel gear 106 is mounted on the retard shaft 80.

One end of a pivot arm 108 is coupled to the retard shaft 80, and the pivot arm 108 is mounted at its pivot point 110 on the stud 104. The opposite end of the pivot arm 108 is coupled to a bracket 114 by a spring 116 for urging the retard shaft 80 towards the drive wheel shaft 78. The spring 116 is secured to the bracket 114 by a bolt 118 that allows adjustment of the distance the pivot arm 108 can move. The retard shaft 80 is free to move within a circular aperture 112 defined in the supporting chassis 82 (which forms part of the dispenser chassis 40).

Referring again to FIG. 2, the transport mechanism 46 comprises stretchable endless belts and a skid plate arrangement. The belts are driven by the motor (not shown) that drives the drive wheel shaft.

The media thickness sensor 48 comprises a linear variable differential transducer (LVDT) as is well known in the art.

The media low indicator 49 includes a magnetic sensor (not shown). When the pusher plate 58 in a hopper 42 is within a predetermined distance of the magnetic sensor, then the magnetic sensor detects the magnet 60 in the pusher plate 58 which indicates that there are few media items left in the hopper 42. The media low indictor 49 then notifies the ATM controller module 22 that the hopper 42 requires replenishment with media.

The operation of the dispenser 20 will now be described with reference to all the drawings. When a media item (such as a telephone card) is to be dispensed, the pick wheels 70 are rotated to pull a card from the hopper 42. The drive wheels 72 and the retard wheels 74 are in the initial position, that is, they are in close proximity or touching each other.

Once the card is picked by the pick wheels 70, the card passes between the drive wheels 72 and the retard wheels 74, thereby deflecting the retard wheels 74 upwards and causing pivot arm 108 to pivot about stud 104. During this pivot action, retard wheel gear 106 remains intermeshed with the double idler gear 98 because the distance between the centers of these gears 98, 106 remains constant. The retard wheels 74 remain in contact with the upper surface of the card because the retard wheels 74 are biased towards the drive wheels 72, thereby ensuring that multiple cards are not picked. When the card has passed between the retard and drive wheels 74, 72 then the pivot spring 116 urges the retard shaft 80 back to the initial position.

Various modifications may be made to the above described embodiment, within the scope of the present invention. In other embodiments, the circular slot may be arcuate. In other embodiments, the drive wheel shaft may be resiliently biases rather than, or in addition to, the retard wheel shaft. In other embodiments, stretchable endless belts may be used for the drive mechanism 90.

What is claimed is:

1. A self-service terminal comprising:

a chassis including a pair of chassis plates spaced apart to slidingly receive a hopper;

the hopper including bottom having a slot therein over which a plurality of media are stacked;

a dispenser including a pick unit mounted to the chassis plates for picking media items from the hopper, the pick unit including a drive wheel for engaging with one surface of a media item in the hopper and mounted on a first rotatable shaft configured for providing power to the pick unit, a retard wheel for engaging with an opposite surface of the media item and mounted on a second rotatable shaft for rotating in the same direction as the first rotatable shaft, and a pick wheel mounted on a third shaft and aligned with the hopper slot, and the first, second, and third shafts being coupled to a common drive component, with the first shaft being coupled to the third shaft and common drive component in turn for transferring power to the common drive component, and the common drive component being independently coupled to the second shaft for transferring power thereto to drive the retard wheel, the drive wheel and the retard wheel being resiliently biased together, at least one of the shafts being pivotally coupled to the common drive component such that the distance between the at least one shaft and the drive component remains constant as the at least one shaft is displaced by a media item passing between the wheels.

2. A terminal according to claim 1, wherein the second shaft is resiliently biased and located in a slot disposed in said chassis, so that as the second shaft is displaced it moves within the slot, thereby maintaining a constant distance from the drive component.

3. A terminal according to claim 1, wherein the drive component is part of a drive mechanism implemented by intermeshing gears.

4. A terminal according to claim 1, wherein the second shaft is pivotally coupled to a bracket by an arm.

5. A terminal according to claim 4, wherein the arm has a pivot point at the center of the common drive component.

6. An automated teller machine (ATM) comprising:

a chassis including a pair of chassis plates spaced apart to slidingly receive a hopper;

the hopper including a bottom having a slot therein over which a plurality of media are stacked;

a cash dispenser including a pick unit mounted to the chassis plates for picking currency items from the hooper, the pick unit including a drive wheel for engaging with one surface of a currency item in the hopper and mounted on a first rotatable shaft configured for providing power to said pick unit, a retard wheel for engaging with an opposite surface of the currency item and mounted on a second rotatable shaft for rotating in the same direction as the first rotatable shaft, and the first, second, and third shafts being coupled to a common drive component, with the first shaft being coupled to the third shaft and common drive component in turn for transferring power to the common drive component, and the common drive component being independently coupled to the third shaft for transferring power thereto to drive the retard wheel, the drive wheel and the retard wheel being resiliently biased together, at least one of the shafts being pivotally coupled to the common drive component such that the distance between the at least one shaft and the drive component remains constant as the at least one shaft is displaced by a currency item passing between the wheels.

7. An ATM according to claim 6, wherein the second shaft is resiliently biased and located in a slot disposed in the chassis, so that as the second shaft is displaced it moves within the slot, thereby maintaining a constant distance from the drive component.

8. An ATM according to claim 6, wherein the drive component is part of a drive mechanism implemented by intermeshing gears.

9. An ATM according to claim 6, wherein the second shaft is pivotally coupled to a bracket by an arm.

10. An ATM according to claim 9, wherein the arm has a pivot point at the center of the common drive component.

11. A dispenser for dispensing different types of media items, the dispenser comprising:

a drive wheel for engaging with one surface of a media item and mounted on a first rotatable shaft configured for receiving power, a retard wheel for engaging with an opposite surface of the media item and mounted on a second rotatable shaft for rotating in the same direction as the first rotatable shaft, a pick wheel mounted on a third shaft;

the first, second, and third shafts being coupled to a common drive component, with the first shaft being coupled to the third shaft and common drive component in turn for transferring power to the common drive component, and the common drive component being independently coupled to the second shaft for transferring power thereto to drive the retard wheel, and the drive wheel and the retard wheel being resiliently biased together, at least one of the shafts being pivotally coupled to the common drive component such that the distance between the at least one shaft and the common drive component remains constant as the at least one shaft is displaced by a media item passing between the wheels.

12. A dispenser for dispensing different types of media items, the dispenser comprising:

a common drive component;

first, second, and third rotatable shafts coupled to the common drive component, with the first shaft being coupled to the third shaft and common drive component in turn for transferring power to the common drive component, and the common drive component being independently coupled to the second shaft for transferring power thereto;

a drive wheel mounted on the first rotatable shaft and for engaging with one surface of a media item, with the first shaft being configured for receiving power;

a retard wheel mounted on the second rotatable shaft and for (i) engaging with an opposite surface of the media item, and (ii) rotating in the same direction as the first rotatable shaft;

a pick wheel mounted on the third shaft for driving the media item to the drive wheel;

means for resiliently biasing the drive wheel and the retard wheel together; and means for pivotally coupling at least one of the shafts to the common drive component such that the distance between the at least one of the shafts and the common drive component remains constant as the at least one of the shafts is displaced by a media item passing between the wheels.

13. A dispenser according to claim 12, wherein the means for resiliently biasing the drive wheel and the retard wheel together comprises a spring member.

14. A dispenser according to claim 12, further comprising means defining a slot in which the second shaft is resiliently biased and located such that the second shaft moves within the slot when the second shaft is displaced, thereby maintaining a constant distance from the common drive component.

15. A dispenser according to claim 12, wherein the common drive component is part of a drive mechanism which is formed by a number of intermeshing gears.

* * * * *